United States Patent [19]

Bilbrey

[11] 4,305,668

[45] Dec. 15, 1981

[54] VORTEXER

[75] Inventor: Robert A. Bilbrey, Orinda, Calif.

[73] Assignee: Scientific Manufacturing Industries, Inc., Emeryville, Calif.

[21] Appl. No.: 138,416

[22] Filed: Apr. 8, 1980

[51] Int. Cl.[3] ..... B01F 11/00; B01L 11/00

[52] U.S. Cl. ..... 366/111; 366/114; 366/208; 366/347; 422/99

[58] Field of Search ..... 366/111, 114, 208, 347; 422/99, 102, 104; 108/144

[56] References Cited

U.S. PATENT DOCUMENTS

| | | | |
|---|---|---|---|
| 2,952,145 | 9/1960 | Thompson | 108/144 X |
| 3,179,071 | 4/1965 | Johnston | 108/144 |
| 3,661,189 | 5/1972 | Bowser et al. | 422/100 X |
| 3,871,832 | 3/1975 | LeBlanc | 422/104 |
| 4,118,801 | 10/1978 | Kraft et al. | 366/208 X |
| 4,202,634 | 5/1980 | Kraft et al. | 366/208 X |

*Primary Examiner*—Arnold Turk

[57] ABSTRACT

A vortexer apparatus having a hold down plate detachably mounted to an upright cylindrical support, said support having a pair of splines formed thereon, the end of one spline being spaced from the near end of the other spline by a circumferential groove, said hold down plate being supported from an elongate sleeve axially engageable with said support, and having a key engageable with said pair of splines. A torque arm is provided for selectively locating the cylindrical support and hold down plate relative to a base and an agitated platform.

5 Claims, 7 Drawing Figures

VORTEXER

SUMMARY OF THE INVENTION

This invention relates generally to apparatus for producing a vortex, to the mixing of liquids contained in laboratory vessels such as test tubes and, more particularly, to vortexers capable of supporting and agitating a plurality of vessels at one time.

In brief, this invention relates to a particular structural arrangement for supporting a hold down plate relative to a base and an agitated platform.

One object of the present invention is to provide a vortexer apparatus having a hold down plate which is supported from a single, cylindrical support spindle and which may be used in connection with laboratory vessels and racks of various lengths and sizes.

Another object is to provide a vortexer apparatus of the kind described and wherein the hold down plate may be lifted with one hand, then pivoted to one side of an agitated platform, permitting easy removal and substitution of laboratory vessels and support racks.

It is a still further object of the invention to provide a vortexer of the kind described including means for rotationally locating a cylindrical support and a hold down plate relative to a base and an agitated platform.

Other objects of this invention will become apparent in view of the following detailed description.

In the drawings forming a part of this application and in which like parts are identified by like reference numerals, FIG. 1 is a perspective view of a preferred embodiment of the invention in a vortexer apparatus;

Figure 1:
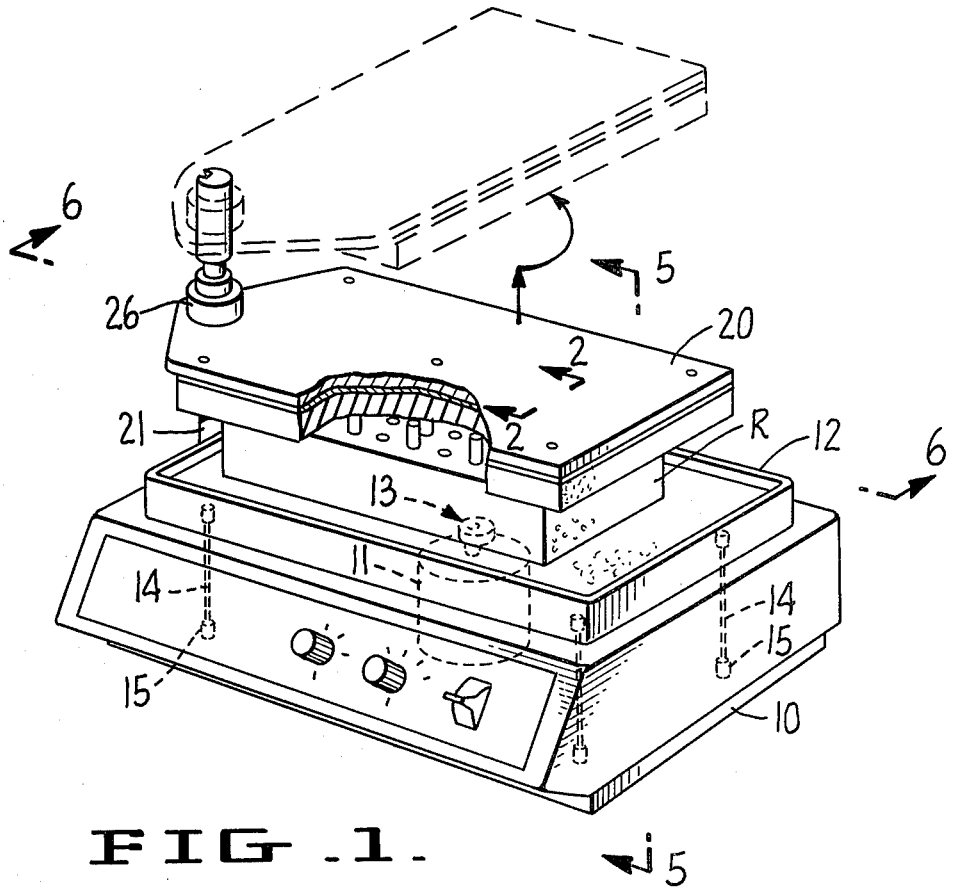
Figure 5:
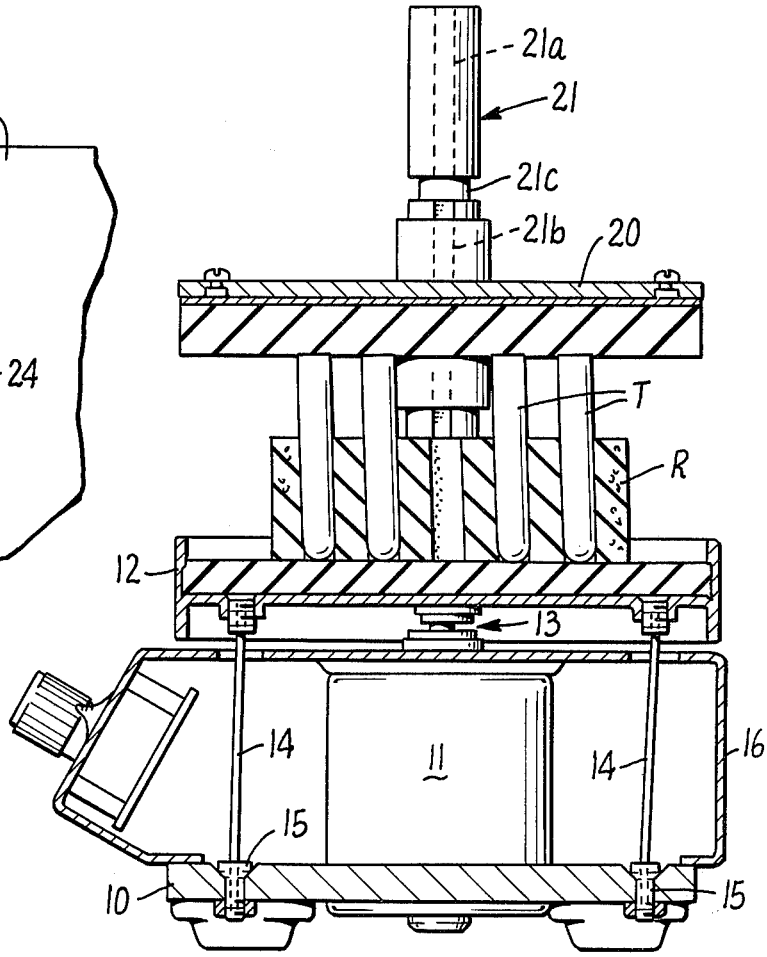
FIG. 5 is an elevation of the vortexer viewed on line 5—5 of FIG. 1.
Figure 6:
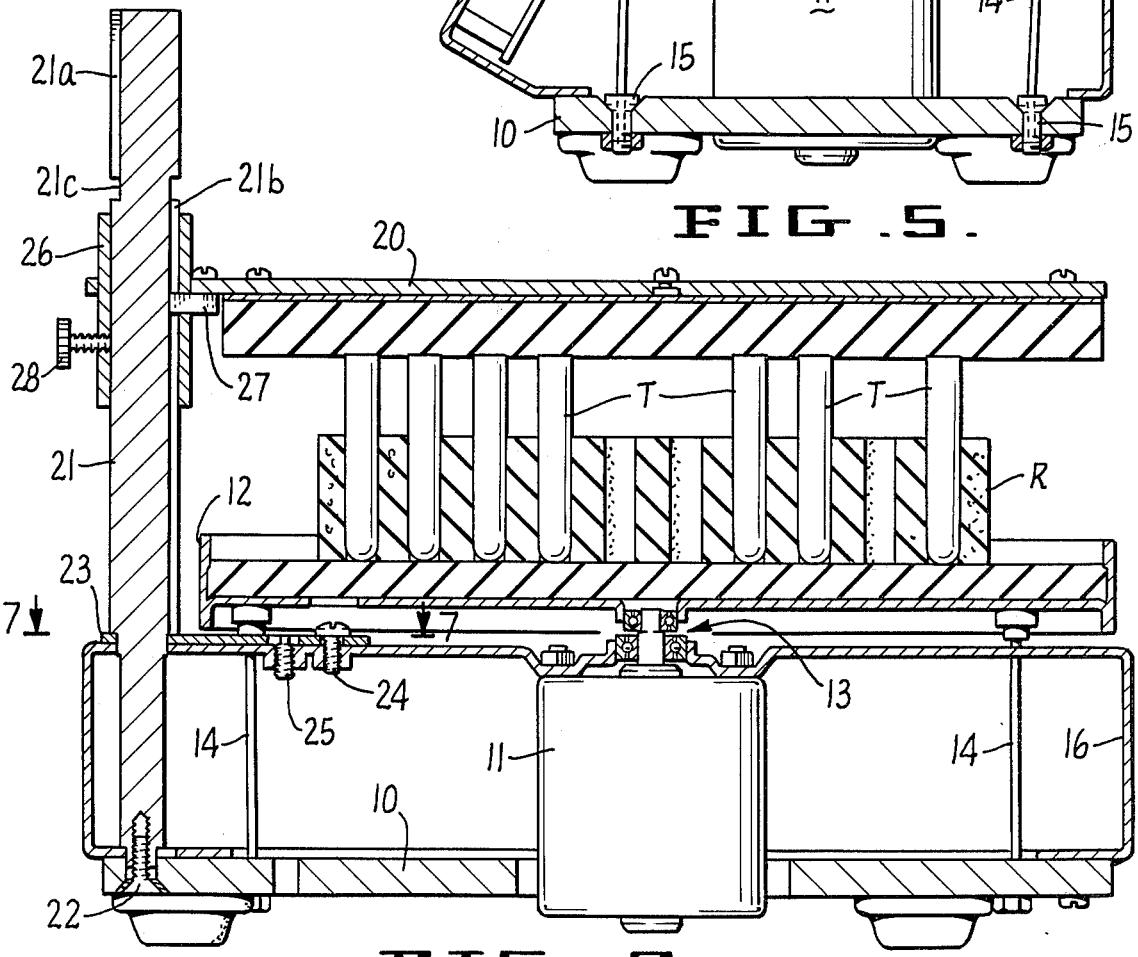
FIG. 6 is an elevation of the vortexer viewed on line 6—6 of FIG. 1.

Referring to FIGS. 1, 5 and 6 in particular, the vortexer apparatus generally comprises a base 10, a motor 11 mounted to said base, an agitated platform 12 resiliently supported from the base and connected to motor 11 by an eccentric crank and coupling 13. Agitated platform 12 is resiliently supported upon a set of four wires 14, the lower end of each wire being secured in a holder 15 mounted to base 10. A housing 16 essentially encloses motor 11, wire 14 and the operating circuitry of the vortexer. This arrangement of apparatus is essentially known and is utilized in connection with other forms of vortexer apparatus.

Figure 7:
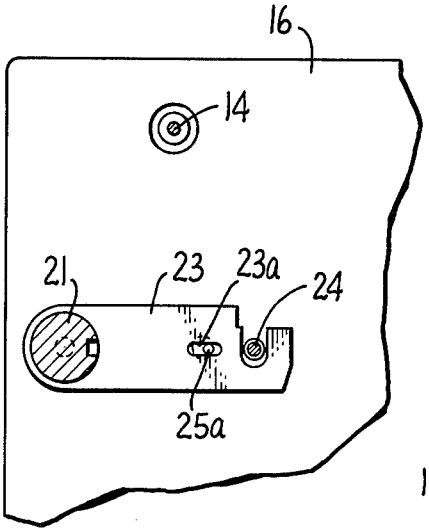
FIG. 7 is a plan view and partial section taken on line 7—7 of FIG. 6.

The present invention is more especially directed to the means provided for mounting a hold down plate 20 relative to agitated plate 12 and base 10. For this purpose there is provided a cylindrical support splindle 21, secured to base 10 by a screw 22, and maintained upright by housing 16. A torque arm 23 is fitted to the lower portion of support spindle 21, and made a part thereof either with a force fit or by welding, and the torque arm is secured to the housing 16 by a set screw 24. Torque arm 23 is provided with a slot 23*a* which allows the torque arm to be angularly pivoted relative to the base through small angles of adustment and then secured by set screw 24 when properly located. Slight angular adjustments of the torque arm and support spindle 21 are made by an eccentric 25 threadably received in housing 16. The upper end of eccentric 25 carries a pin 25*a*, said pin being offset relative to the axis of threading and received in an opening 23*b* of the torque arm. This arrangement is best shown in FIG. 7.

The angular orientation of support spindle 21 is of importance in locating the hold down plate 20 directly above agitated platform 12. The mechanism provided for angularly positioning spindle 21 allows this to be done quite easily at the time of assembly, notwithstanding a manufacture of parts which may vary slightly in size and built to loose tolerances.

Support spindle 21 is formed with a pair of splines 21*a* and 21*b*, the lower end of upper spline 21*a* being spaced from the upper end of lower spline 21*b* by a circumferential groove 21*c*. It will be further noted that the pair of splines 21*a* and 21*b* are formed on opposite sides of support 21 in an axial misalignment relative to each other.

Plate 20 is adapted to be mounted to and supported from spindle 21 through an elongate sleeve 26, the internal diameter of sleeve 26 being only slightly greater than the outer diameter of support spindle 21. A key 27 is secured to sleeve 26, said key being engageable with either of said pair of splines 21*a* or 21*b*, or groove 21*c*, when properly aligned therewith. In the position shown in FIGS. 5 and 6, key 27 is engaged with spline 21*b*, and in that position allows hold down plate 20 to be lowered upon a set of laboratory test tubes T supported in a rack R. Although the weight of plate 20 may be sufficient to hold the upper ends of each tube T in a relatively fixed or steady position, the hold down pressure may be increased. For this purpose a set screw 28 is provided to secure sleeve 26 at a set position along support spindle 21. To increase the pressure above that provided by the weight of plate 20 alone, hand pressure is applied to the top of plate 20 with set screw 28 backed off. With the desired or necessary pressure applied, set screw 28 is then threaded into engagement with the surface of spindle 21. If desired, indentations may be formed along spindle 21 to receive the end of the set screw in various "set" positions.

FIG. 1 illustrates in broken line a position for hold down plate 20 allowing removal of rack R and test tubes T. This position is attained simply by backing off set screw 28, lifting table 20 until key 27 extends beyond spline 21*b* and becomes aligned with groove 21*c*, and then rotating plate 20. Key 27 will then track within groove 21*c* supporting table 20 at that position.

It will be further seen that table 20 and sleeve 26 may be removed entirely from spindle 21 by simply rotating plate 20 until key 27 becomes aligned with groove 21*a*, then lifting the table and sleeve 26 axially from the spindle support.

Figure 2:
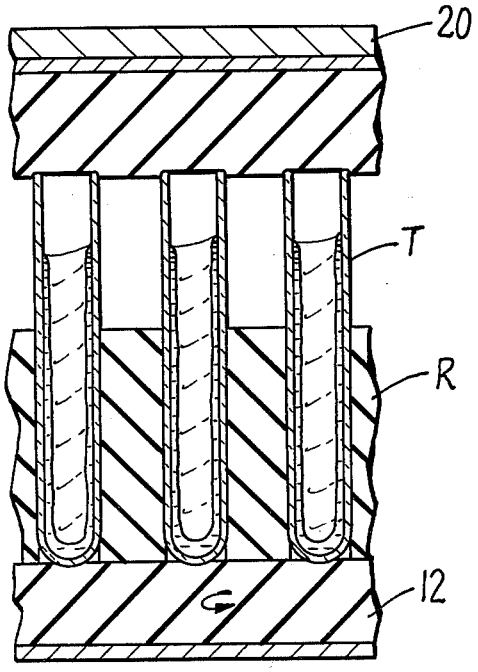
FIGS. 2, 3 and 4 illustrate various sizes of laboratory vessels and holders which may be used with the vortexer apparatus.
Figure 3:
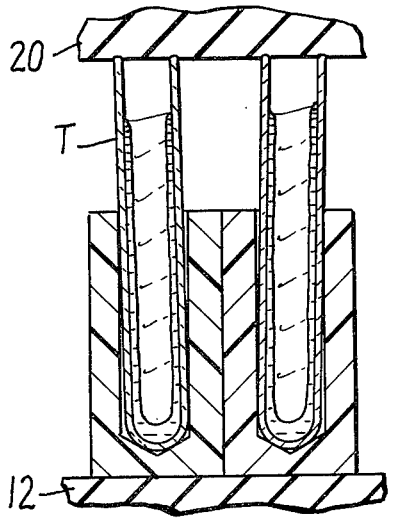
Figure 4:
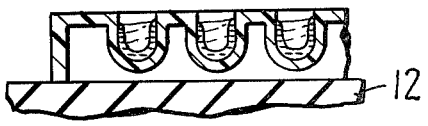

FIGS. 2, 3 and 4 illustrate various types of racks and vessels which may be utilized in connection with the vortexer. Such racks and vessels are commonly known and used in connection with other vortexers.

Although a preferred embodiment of the invention has been illustrated and described, various modifications and changes may be resorted to without departing from the spirit of the invention of the scope of the appended claims, and each of such modifications and changes is contemplated.

What is claimed is:

1. In a vortexer apparatus having a base, a motor mounted to said base, an agitated platform resiliently supported from said base and connected to said motor by an eccentric crank, and a hold down plate, the improvement comprising: an upright cylindrical support mounted to said base, said support having a pair of splines formed thereon, the end of one spline being spaced from the near end of the other spline by a circumferential groove; and means for detachably mounting said hold down plate to said support including an elongate sleeve axially engageable with said support and having a key engageable with said pair of splines and groove; whereby said plate may be selectively movable on said support to alternative positions, said key being engageable with either one of said splines or with said circumferential groove.

2. The vortexer apparatus of claim 1, said pair of splines being formed in an axial misalignment relative to each other, a rotation of said plate and sleeve being necessary to move said key from an alignment with one spline to an alignment with the other spline.

3. The vortexer apparatus of claim 1, and further comprising a torque arm for rotationally locating said cylindrical support on said base, said torque arm being secured to said support and having a slot engageable with a set screw threaded to said base.

4. The vortexer apparatus of claim 3, said torque arm having an opening; and an eccentric mounted to said base, said eccentric having a pin received in the opening of said torque arm, the rotational position of said eccentric locating said torque arm and cylindrical support relative to said base.

5. The vortexer apparatus of claim 1, and further comprising a set screw threadably secured in said sleeve and engageable with said cylindrical support when said key is engaged with the lower one of said pair of splines.

* * * * *